United States Patent [19]

Alberts et al.

[11] Patent Number: 4,464,506

[45] Date of Patent: Aug. 7, 1984

[54] GRAFT-MODIFIED SILOXANE DISPERSIONS FOR FINISHING TEXTILE MATERIALS

[75] Inventors: Heinrich Alberts, Odenthal; Helmut Steinberger, Leverkusen; Wilfried Kortmann, Hagen, all of Fed. Rep. of Germany

[73] Assignee: Bayer Aktiengesellschaft, Leverkusen, Fed. Rep. of Germany

[21] Appl. No.: 454,829

[22] Filed: Dec. 30, 1982

[30] Foreign Application Priority Data

Jan. 16, 1982 [DE] Fed. Rep. of Germany ..... 3201205

[51] Int. Cl.[3] ..... C08F 283/12

[52] U.S. Cl. ..... 524/588; 524/731; 524/376

[58] Field of Search ..... 528/26, 25, 24, 28; 524/588, 731, 837, 862

[56] References Cited

U.S. PATENT DOCUMENTS

| | | | |
|---|---|---|---|
| 3,249,581 | 5/1966 | Nelson | 524/861 |
| 3,555,109 | 1/1971 | Getson | 528/25 |
| 3,580,971 | 5/1971 | Getson | 528/26 |
| 3,627,836 | 12/1971 | Getson | 528/26 |
| 4,014,851 | 3/1977 | Bluestein | 524/425 |
| 4,123,472 | 10/1978 | Getson | 528/26 |
| 4,166,078 | 8/1979 | Getson | 528/26 |
| 4,211,729 | 7/1980 | Marquardt et al. | 528/26 |

FOREIGN PATENT DOCUMENTS

| | | |
|---|---|---|
| 0002744 | 7/1979 | European Pat. Off. . |
| 0004947 | 10/1979 | European Pat. Off. . |
| 7706000 | 9/1977 | France . |
| 7700475 | 12/1977 | France . |

*Primary Examiner*—C. Warren Ivy

*Attorney, Agent, or Firm*—Sprung, Horn, Kramer & Woods

[57] ABSTRACT

A graft polymer dispersion suitable for finishing textiles and comprising water, a dispersing auxiliary and a polymeric product produced by subjecting to free radical polymerization a composition comprising (A) an organopolysiloxane containing vinyl groups, (B) an organopolysiloxane containing Si-H groups, and (C) a polymerizable vinyl monomer, some of the organopolysiloxane components being linked via polymerized units of the vinyl monomer and some of the Si-H groups of the Si-H-organopolysiloxane being modified by mono-addition of the vinyl monomer.

6 Claims, No Drawings

GRAFT-MODIFIED SILOXANE DISPERSIONS FOR FINISHING TEXTILE MATERIALS

The present invention relates to textile-finishing agents based on aqueous silicone graft polymer dispersions which are obtained in water by emulsifying graft polymers which contain, as grafting substrate, mixtures of polysiloxanes containing vinyl groups and polymethylhydrogensiloxanes and, as grafted-on polymer component, polymerized units of vinyl monomers.

Silicones are used in the textile industry as water repellents. Compared with other strongly hydrophobic substances, for example paraffin and waxes, silicones have the advantage that they do not have a fatty character, which fact has a beneficial effect on the handle of the treated fabric; that they can be fixed on the fiber in such a way that they withstand to a comparatively high extent a wash or solvent treatment of the textile; that they are largely resistant to chemicals and weathering and, finally, that they exert a considerable softening and smoothing effect on the textile.

However, the softening effect of silicones is so strong in the case of some textiles (cotton, polyester and polyamide) that the treated textile finally has a soft and floppy handle, which can be undesirable for some uses.

On the contrary, the ability to recover and a certain elasticity of the treated fabric are required.

According to the state of the art, acrylates or polyacrylates and methacrylates can be used to increase the stiffness of fabrics. However, these products do not impart the desired elasticity and the recovery capacity to the textiles, not even when used in combination with silicones.

It was therefore the object of the present invention to develop finishing agents which impart to sheet-like or fibrous textile structures not only springiness but also a certain capacity for recovery at the same time as providing a soft and voluminous handle.

The object according to the invention is achieved by using, to finish textile material, aqueous dispersions of special graft copolymers which are obtained by polymerizing vinyl monomers in the presence of mixtures of polymethylhydrogensiloxanes and polysiloxanes containing vinyl groups.

The present invention therefore relates to textile-finishing agents containing a graft polymer dispersion consisting of diorganopolysiloxane containing vinyl groups, methylhydrogenpolysiloxane and polymerized units of optionally halogen-containing vinyl and/or (meth)acrylic compounds.

The graft modification of organopolysiloxanes with vinyl monomers is described, for example, in Patent Specifications GB Nos. 766,528, 806,582, 869,482 and German Auslegeschrift No. 1,694,973. It is also known from U.S. Pat. No. 4,166,078 to modify Si-H-siloxanes by grafting with vinyl monomers. Furthermore, U.S. Pat. No. 4,172,101 describes the graft-modification of vinyl-substituted polysiloxanes.

Furthermore, W. Noll "Chemie und Technologie der Silicone [Chemistry and Technology of Silicones]"; Verlag Chemie, Weinheim, Bergstr. 2nd edition (1968), page 391 describes how the combination of Si-H-siloxanes with Si-vinylsiloxanes in the presence of free-radical formers leads to crosslinked products.

It has been found, surprisingly, that uncrosslinked and, in some cases, low viscosity graft polymers are obtained in the free-radical polymerization of vinyl monomers in the presence of mixture of Si-H-siloxanes and Si-vinylsiloxanes.

The graft polymers contain (A) polymethylhydrogensiloxanes of the general formula

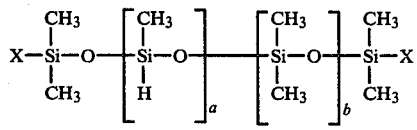

wherein a denotes an integer between 1 and 120, b denotes an integer between 0 and 140 and X denotes a methyl group or hydrogen;

(B) polysiloxanes containing vinyl groups and of the formula

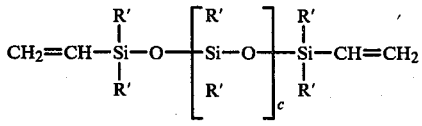

wherein R' is so chosen from alkyl radicals having 1 to 32 carbon atoms, aryl radicals, vinyl radicals and fluoroalkyl radicals having 3 to 18 carbon atoms that the polymer contains 0.0002 to 3% by weight of vinyl and c has a value which is such that the viscosity of the polymer varies between 100 and 1,000,000 mPa at 25° C.; and (C) vinyl monomers, of which the following are examples which may be mentioned: olefins, such as ethylene, propylene, isobutylene, vinyl esters of aliphatic or aromatic carboxylic acids, preferably vinyl acetate and vinyl propionate and $\alpha,\beta$-unsaturated monocarboxylic or dicarboxylic acids and their derivatives, the following may be mentioned: (meth)acrylic acid, methyl (meth)acrylate, ethyl (meth)acrylate, propyl or isopropyl (meth)acrylate, n-butyl, isobutyl or tert.-butyl (meth)acrylate, 2-ethylhexyl (meth)acrylate, (meth)acrylamide derivatives, quaternized (meth)acrylamide derivatives, (meth)acrylonitrile, maleic anhydride, maleinamide, N-alkyl-maleinamides and -maleinimides, half-esters or diesters of maleic acid, vinyl aromatics, such as styrene, $\alpha$-methylstyrene, 4-chlorostyrene, vinyl chloride, vinylidene chloride, vinylidene fluoride, tetrafluoroethylene, vinyl ethers, such as ethyl vinyl ether or n-butyl vinyl ether; the following may be mentioned from the series of the allyl compounds: allyl alcohol, allyl acetate, isobutene diacetate, 2-methylenepropane-1,3-diol, allylethyl carbonate and allylphenyl carbonate.

If it is desired to crosslink the vinyl resin phase or to increase the molecular weights thereof, multiply unsaturated vinyl compounds or allyl compounds can be used. Examples which may be mentioned are divinylbenzene, (meth)acrylates of polyhydric alcohols, such as, for example, ethylene glycol dimethacrylate, diethylene glycol diacrylate and divinyl ether, and also triallyl cyanurate and triallyl citrate.

The mixtures of polymethylhydrogensiloxanes, polysiloxanes containing vinyl groups and vinyl monomers are subjected to a free-radical polymerization with the addition of free-radical formers and, if appropriate, molecular weight regulators. Stable dispersions are obtained which consist of an organopolysiloxane component and polymerized units of one or more vinyl monomers and which are characterized in that they contin organopolysiloxane graft polymers crosslinked via polymerized units of the vinyl monomers used and some of the Si-H groups of the polymethylhydrogensiloxanes are modified by monoaddition of the vinyl compounds used. Graft polymers prepared in such a way are, depending on the composition, soluble or dispersible in water; even at a high content of silicone, these polymers are readily emulsified in water by the addition of relatively small amounts of emulsifier. The water-soluble or water-dispersible organopolysiloxane graft polymers used according to the inventionn consist of:

1. 15 to 95% by weight of a grafting substrate consisting of
   A. 5 to 95% by weight of diorganopolysiloxane containing vinyl groups and
   B. 5 to 95% by weight of methylhydrogenpolysiloxane and
2. 85 to 5% by weight of polymerized units of vinyl compounds, the total amount of components 1. and 2. always being 100%.

The aqueous polysiloxane formulations according to the invention preferably contain graft polymer dispersions consisting of 1. 40–90% by weight of a grafting substrate consisting of
   (a) 20–80% by weight of diorganopolysiloxane containing vinyl groups and
   (b) 80–20% by weight of polymethylhydrogensiloxane and
2. as at least partially grafted-on polymer phase 60 to 10% by weight of polymerized units of n-butyl acrylate, the total amount of the components always being 100% by weight.

The free-radical polymerization of the vinyl monomers can be started in a way which is in itself known with the aid of free-radical formers, UV radiation or $\alpha$-, $\beta$- or $\gamma$-rays or thermally without furher additives. The radiation-initiated polymerization is preferably carried out in the presence of sensitizers, compare, for example, A. D. Jenkins and A Ledwith, Reactivity, Mechanism and Structure in Polymer Chemistry, John Wiley + Son, London, New York, 1974, page 465.

To start the free-radical polymerization of the vinyl monomers, free-radical formers are used in amounts between 0.001 to 2, preferably 0.02 to 0.8,% by weight, relative to the total mixture of organopolysiloxane, polyester and vinyl monomers. Examples which may be mentioned of free-radical formers are azo initiators, such as azobisisobutyronitrile (AIBN), azo esters, azoiminoesters or azo-N-alkylamides, peroxides, such as di-tert.-butyl peroxide, dicumyl peroxide or dibenzoyl peroxide, peresters, such as amyl perpivalate, tert.-butyl perpivalate, tert.-butyl peroctoate, tert.-butyl perbenzoate or tert.-butyl perneodecanoate, percarbonates, such as cyclohexyl percarbonate or bis-isopropyl percarbonate or hydroperoxides, such as, for example, cumyl hydroperoxide or tert.-butyl hydroperoxide.

Other suitable initiators are benzopinacol, benzopinacol derivatives or other thermally labile highly substituted ethane derivatives.

The polymerization can also be started with the aid of redox systems at temperatures which are lower than the purely thermal decomposition temperatures of the free-radical formers.

Examples which may be mentioned of redox initiators are combinations of peroxides and amines, such as, for example, benzoyl peroxide and triethylamine, trialkylboron compounds and oxygen, hydroperoxides and sulphinic acids, formaldehyde or aldoses or combinations with low-valent transition metal salts and sulphur dioxide/peroxide redox systems.

The polymerization reaction can be carried out continuously or discontinuously, unpressurized or under reaction pressures up to, for example, 300 bar, preferably up to 15 bar, at reaction temperatures between −20° C. and +250° C., preferably 70° to 190° C. If desired, the polymerization can also be carried out in the presence of solvents or diluents, of which mention may be made of water, alcohols, such as methanol, ethanol or tert.-butanol, aliphatic or aromatic hydrocarbons, halogenated hydrocarbons, such as chlorobenzene or fluorinated compounds, ethers, such as dioxane or tetrahydrofuran, and esters, such as, for example, ethyl acetate. However, preferably the polymerization is carried out without solvent.

If desired, the polymerization reaction can be carried out in the presence of molecular weight regulators. Regulators which may be mentioned are mercaptans, such as n- or tert.-dodecylmercaptan, thioglycol, thioglycerol or thioacetates. Further, sulphur-free molecular weight regulators, such as hydrocarbons, of which may be mentioned by way of example paraffin fractions, such as, for example, petroleum ether, light or cleaner's naphtha, $\alpha$-olefins, such as, for example, propylene, isobutylene or 1-butene, also ketones, such as, for example, acetone, methyl ethyl ketone or cyclohexanone, also aldehydes, such as, for example, formaldehyde, acetaldehyde, propionaldehyde or isobutyraldehyde, or allyl compounds, such as, for example, allyl alcohol, allyl acetate, isobutene diacetate or allyl carbonates. Enol ethers which are derived, on the one hand, from aliphatic or cycloaliphatic aldehydes or ketones and, on the other hand, from alkyl, cycloalkyl or aralkyl alcohols are suitable for the process according to the invention. The cycloaliphatic aldehydes or ketones can be ring-substituted or bridged and/or contain a double bond. Examples which may be mentioned are butyraldehyde, valeraldehyde, cyclohexylaldehyde, cyclohexenylaldehyde, bicyclo[2.2.1]hexenylaldehyde and cyclohexanone. Those cycloaliphatic aldehydes or ketones are preferable which are optionally ring-substituted by one or two $C_1$–$C_5$-alkyl groups, in particular by methyl groups.

Suitable alcohols are $C_1$–$C_{20}$-alkanols which can be optionally branched or unsaturated and $C_5$–$C_{10}$-cycloalkanols and $C_7$–$C_{20}$-aralkyl alcohols the cycloalkyl or aryl group of which can optionally be substituted by lower alkyl radicals. Examples which may be mentioned are methanol, ethanol, n-propanol, isobutanol, 2-ethylhexanol, cyclohexanol and benzyl alcohol.

The preparation of enol ethers is extensively described in the literature, for example in Houben-Weyl, Methoden der Organischen Chemie [Methods of organic chemistry], volume VI/3, page 90, Georg Thieme Verlag, Stuttgart, 1965.

Enol ethers used as molecular weight regulators are used in amounts of 0.01–10% by weight, preferably of 0.05–1% by weight, relative to the total amount of the monomers. The enol ethers can be added during the polymerization at any time, but preferably the enol ether used as regulator is added at the start of the polymerization Possible telogens are also halogenated hydrocarbons, such as methylene chloride, tetrachloroethane, dibromoethane and the like. As expected, the viscosities of the dispersions can be controlled with the aid of regulators of this type.

The graft polymer dispersions are prepared by raising mixtures of a terminally vinyl-functional organopolysiloxane, a methylhydrogenpolysiloxane and one or more vinyl monomers in the presence of a free-radical former to a reaction temperature which initiates the polymerization. If desired, mixtures of terminally vinylfunctional and nonfunctional organopolysiloxanes can also be added to the reaction mixture. The polymerization can be carried out continuously or discontinuously. The order in which the components to be reacted are added is in principle optional, but the best results are obtained when mixtures of vinylsiloxane and hydrogensiloxane and vinyl monomers are simultaneously used when carrying out the polymerization reaction.

The degree of conversion of the monomers used depends on the polymerization process chosen and on the reaction conditions. In the discontinuous polymerization method, the highest possible conversions are aimed at, so that at least 80% of the monomers used, preferably more than 90%, are converted. Residual monomers are removed by known methods using distillation under atmospheric pressure or under reduced pressure. The residual monomer contents actually still found in the dispersions after working up are negligibly low, being in general below 1,000 ppm, preferably below 100 ppm.

In the course of the free-radical grafting reaction, not only polymerization and grafting polymerization of the vinyl monomers takes place, but also a mono-addition of the vinyl monomers to the Si-H function of the methyl-H-siloxanes, approximately according to the following equation:

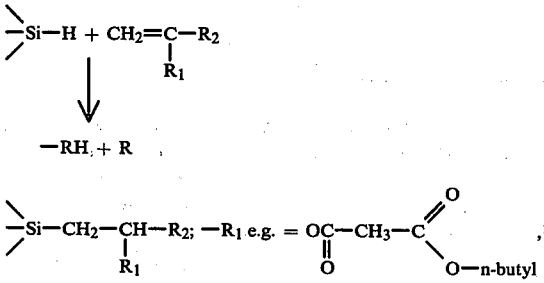

$C_6H_5$, F; $-R_2$ e.g. H, F, $CH_3$.

This mono-addition alters the polarity and the hydrophobic character of the polysiloxane chain and the interaction with the textile substrate is improved.

The silicone/vinyl polymer dispersions obtained according to the invention are particularly suitable for coating and finishing natural or synthetic fibers, filaments or textile sheet structures. They impart to textile articles not only the voluminous soft handle characteristic of silicone but also a permanent elasticity and capacity for recovery.

The silicone/vinyl polymer dispersions obtained according to the invention have, compared to pure silicones of corresponding viscosity, a comparatively more favorable emulsifying behavior.

They are relatively readily convertible with the aid of known emulsifiers and emulsifying techniques into stable emulsions.

The emulsifiers used advantageously consist of a mixture of a hydrophilic and a hydrophobic component. Examples of suitable compounds are fatty acid esters of polyhydric alcohols, such as, for example, stearates of glycols, glycerol or sorbitol, and higher fatty alcohols or the addition products of ethylene oxide to these fatty alcohols, fatty acids or similar compounds having an active hydrogen atom. However, anionic emulsifiers, such as sodium lauryl-sulphate or sodium dodecylbenzenesulphonate, or also cationic emulsifiers, such as quaternary ammonium compounds, are also suitable.

The silicone/vinyl copolymers are applied to the substrate to be treated by known methods, for example by padding, drying and condensing, by spraying or nip-padding.

After the aqueous silicone graft polymer dispersion according to the invention has been applied to the textile substrate, thermally or catalytically initiated crosslinking of the silicone graft polymer component can take place, if appropriate with the addition of further reactive silicone derivatives, such as, for example, polymethylhydrogensiloxanes. The purely thermal crosslinking takes place at temperatures from about 120° C. The catalytically activated crosslinking can take place even at room temperature. Possible catalysts are the known systems, such as platinum or platinum compounds or organotin compounds but also peroxides or other free-radical starters. Crosslinking activated by UV radiation can also be carried out successfully. The crosslinking improves the solvent- and wash-resistance of the finish. In the catalytic crosslinking, it is advisable to use corresponding inhibitors, such as, for example, acetylene alcohols, in particular methylenetinol. The examples which follow are intended to illustrate the invention in more detail without restricting it in its scope.

Unless otherwise indicated, quantitative data are understood as being parts by weight or percentages by weight.

Preparation of the starting substances:

The polydiorganosiloxanes are prepared in a way which is in itself known (compare W. Noll, "Chemie und Technologie der Silicone [Chemistry and Technology of Silicones]", Verlag Chemie, Weinheim/Bergstrasse, 2nd edition, 1968, chapter 5, page 162 et seq.).

The siloxanes mentioned in the examples are characterized as follows:

| Polysiloxane | Description | Viscosity mPa (25° C.) |
|---|---|---|
| A | Terminated by trimethylsilyl groups | 1000 |
| B | Terminated by vinyl groups | 10000 |
| C | Si—H—containing, terminated by trimethylsilyl groups | 20 |
| D | Si—H—containing, terminated by trimethylsilyl groups | 800 |

EXAMPLE 1

10.5 kg of a polysiloxane B and 9 kg of a polysiloxane C are initially introduced into a 40 liter autoclave equipped with a reflux condenser and heated to 110° C.

while nitrogen is passed over. 2 solutions are then simultaneously added in the course of 5 hours:
Solution 1: 7.5 kg of n-butyl acrylate
Solution 2:
1.5 kg of polysiloxane C
45 g of t-butyl perpivalate
The batch is stirred for 1 hour, and the volatile constituents are then removed by distillation. Viscosity at 25° C: 12,000 mPa.

Composition

37% of units of polysiloxane B
37% of units of polysiloxane C
26% of polymerized units of n-butyl acrylate

EXAMPLE 2

In a 6 liter stirred vessel, 3 kg of polysiloxane B and 150 g of polysiloxane C are heated to 100° C. A solution of 1.75 kg of n-butyl acrylate, 15 g of tetrahydrobenzaldehydebenzyl-enol ether and 7.5 g of t-butyl perpivalate is then pumped in in the course of 5 hours. The batch is stirred for 1 hour and the volatile constituents are removed in vacuo. The final product has a viscosity of 40 mPa at 25° C. and the following composition:
28% of polymerized units of butyl acrylate
3 % of units of polysiloxane C
69% of units of polysiloxane B

EXAMPLE 3

In a 6 liter stirred vessel, 1,500 g of polysiloxane B, 750 g of polysiloxane D, 750 g of polysiloxane C and 1 g of tetrahydrobenzaldehyde-enol ether are heated to 150° C. under nitrogen. Two solutions are then added simultaneously in the course of 4 hours:
Solution 1: 1,000 g of n-butyl acrylate
Solution 2:
500 g of polysiloxane C
10 g of tert.-butyl peroctoate and
4 g of tetrahydrobenzaldehydebenzyl-enol ether
The batch is stirred for 1 hour at 150° C., then evacuated and freed virtually completely from unconverted monomers. The graft polymer obtained has a viscosity of 1,500 mPa at 25° C. and a composition which corresponds to an 88% conversion of monomer.

EXAMPLES 4 AND 5

The components indicated under "initially introduced" are introduced into a 6 liter stirred vessel under an atmosphere of nitrogen and heated to 110° C. The monomer-initiator solution is added in the course of 3 hours, and the batch is then stirred for 1 hour. After the volatile constituents have been removed in vacuo, the batch is cooled down.

| | Initially introduced | | | | | | | |
|---|---|---|---|---|---|---|---|---|
| | Polysiloxane | | Solution n-butyl | oxy-(*) | | t-butyl | | |
| Example | B | C | acrylate | ester | acrylamide | perpivalate | Amount of distillate | Viscosity at 25° C. in mPa |
| 4 | 1,250 g | 1,250 g | 1,960 g | 40 g | — | 12 g | 7 g | 61,000 |
| 5 | 1,250 g | 1,250 g | 1,960 g | — | 40 g | 12 g | 59 g | 90,000 |

(*)oxyester = propyl-2-hydroxy-methacrylate

EXAMPLE 6

900 g of polysiloxane C and 600 g of polysiloxane B, 2.5 g of di-tert.-butyl peroxide and 450 g of vinylidene fluoride are initially introduced into a 6 liter steel autoclave. The batch is heated to 125° C. and stirred for 30 minutes at 125° C. Solutions 1 and 2 are then added in the course of 3 hours.
Solution 1:
250 g of polysiloxane C and
12.5 g of di-tert.-butyl peroxide
Solution 2: 1,300 g of vinylidene fluoride
The batch is stirred for 1 hour at 125° C., carefully let down and evacuated. The volatile constituents are removed. The graft polymer contains
45% by weight of polymerized units of vinylidene fluoride,
22% by weight of units of polysiloxane B and
33% by weight of units of polysiloxane C

EXAMPLE 7

1.4 kg of an oleyl alcohol reacted with 50 mols of ethylene oxide and 1.2 kg of a tridecyl alcohol reacted with 6 mols of ethylene oxide are added with stirring to 40.0 kg of a graft copolymer dispersion of Example 1. The mixture is heated to 60° C., and 57.4 kg of deionized water are incorporated with stirring. A homogeneous and stable emulsion of the graft copolymer is obtained. If necessary, the emulsion can be homogenized, to obtain a more finely divided state, by means of a high-pressure homogenizing machine (for example Alfa-Laval, SH 20 type) in one or more passes under 200 bar.

EXAMPLES 8 TO 9

The same procedure as illustrated in Example 4 leads to emulsions of copolymers in the following compositions:

| Example | Graft copolymer of example | % by weight | Emulsifier | High pressure homogenization |
|---|---|---|---|---|
| 8 | 2 | 40 | 1.5% of oleyl 50-ethoxylate | — |
| 9 | 3 | 40 | 1.5% of oleyl 50-trioleate 1.5% of decenol 4-ethoxylate | twice 200 bar |

For comparison, samples of cotton poplin shirting are finished with the graft polymer dispersion according to the invention as follows: 120–180 g/l of DMDHEU, 15–30 g/l of graft polymer dispersion of Example 1, 12–18 g/l of $MgCl_2.6H_2O$.
The application takes place in the manner described below.

EXAMPLES 10–15 (Finishing of cotton poplin shirting)

To improve the wash and wear properties of cotton poplin shirting, the materials are finished with synthetic resins, for example with dimethyldihydroxyethyleneurea (=DMDHEU). This, on the one hand, markedly improves the de-creasing behavior, dry or wet, and, on the other hand, worsens the handle, tensile strength, tear strength, scuff resistance and sewability. To compensate for these disadvantages, acrylate dispersions and softeners based on fatty acid amides and/or silicones are added to the finishing liquor.

Example

120–180 g/l of acrylate dispersion
15–30 g/l of softener
12–18 g/l of $MgCl_2.6H_2O$ Application is effected by dipping (liquor pick-up 70–100% by weight of goods), squeezing off and subsequently drying. This is followed by a calendering and condensing step at 140°–160° C. for 4 to 6 minutes.

The liquor is then dropped, and the goods are removed from the dyeing apparatus and continuously dried at 125° C. The handle of the treated goods is full, soft and surface-smooth.

Measurement of the elasticity.

3 test pieces taken from the knitted goods at various places are hung up without touching. A peg is attached to the lower end and loaded with a weight of 25N (2.5 Kp). The elongation of the test piece is measured after 30 minutes. Value measured: % reversible extension.

After the weight has been removed, the remaining elongation is measured after 30 minutes.

| | | | | | | | | |
|---|---|---|---|---|---|---|---|---|
| | | | Value measured: % remaining extension. | | | | | |
| | | | 1% of weight of goods relative | | Reversible extension (%) | | Remaining extension (%) | |
| | | Shear resistance acc. to Schopper DIN 53,863 % by weight loss | Tensile strength 5 cm wide strips warp 270 threads | | | | Crease angle sum of warp and weft | |
| Example | Handle | 6,300 cycles | N | % elongation | N | % elongation | dry | wet |
| 10. Starting material: Co poplin shirting | smooth, brittle, impoverished | 2.9 | 602 | 19.4 | 541 | 24.2 | 76 | 145 |
| 11. 150 g/l of DMDHEU 15 g/l of $MgCl_2.6\ H_2O$ | rough, impoverished, | 4.2 | 355 | 19.3 | 388 | 17.9 | 144 | 215 |
| 12. as 2 + 20 g/l of acrylate | firm, rough, | 3.9 | 366 | 18.6 | 390 | 17.7 | 150 | 213 |
| 13. as 2 + 15 g/l of Si softener | smooth, improverished, | 2.9 | 378 | 18.5 | 372 | 17.3 | 160 | 199 |
| 14. as 2 + 20 g/l of acrylate + 15 g/l of Si softener | smooth, firm, springy, | 3.2 | 405 | 18.5 | 501 | 19.8 | 173 | 220 |
| 15. as 2 + 20 g/l of emulsion acc. to Example 4 | smooth, silky, firm, springy | 2.3 | 517 | 20.7 | 508 | 20.0 | 196 | 235 |
| | | ϕ of 3 individual values | ϕ of 3 individual values | dry | | wet | ϕ of 3 individual values | |

Compared to Example 11, the advantageous handle, tensile strength and crease angle remain virtually unchanged in Example 12, according to the invention, even after 5 washes at 60° C., while Example 11, after 5 washes under identical conditions, shows marked deteriorations in handle (rough and impoverished) and marked diminishing of tensile strength and crease angle.

EXAMPLE 16

Effect on Co circular-knitted goods

100% Co circular-knitted goods (100 kg), structured in the longitudinal direction, is dyed on a jet dyeing machine with reactive dyestuffs, repeatedly rinsed hot and cold and soaped at the boiling temperature, so that all unfixed dyestuff has been removed.

The last rinse bath remains in the machine. 2 kg of a co-graft polymer dispersion according to the invention of Example 4 (corresponding to 2% of the weight of goods) are added via an adding vessel. The pH value of the rinse liquor had first been adjusted to 6.0 with acetic acid.

The treatment bath is heated up at 1° C./min. to 35° C. while the goods are running. After the final temperature has been reached, the goods remain for 15 minutes in the finishing liquor.

| to solids | Length | Width | Length | Width |
|---|---|---|---|---|
| finished with silicone softener | 100 | 346 | 10 | 40 |
| finished with graft polymer dispersion of Example 4 | 80 | 248 | 6 | 25 |

It will be appreciated that the instant specification and examples are set forth by way of illustration and not limitation, and that various modifications and changes may be made without departing from the spirit and scope of the present invention.

We claim:

1. In the finishing of a textile by applying thereto a finishing agent containing an organosiloxane, the improvement which comprises employing as said finishing agent an aqueous dispersion comprising water, an emulsifying agent and a material produced by subjecting to free radical polymerization a composition comprising (A) an organopolysiloxane containing vinyl groups, (B) an organopolysiloxane containing Si-H groups, and (C) a polymerizable vinyl monomer, some of the organopolysiloxane components being linked via polymerized units of the vinyl monomer and some of the Si-H groups of the Si-H-organopolysiloxane being modified by mono-addition of the vinyl monomer.

2. A method according to claim 1, wherein in the composition subjected to polymerization on a weight basis A+B is present in about 15–95%, and C is present in about 85–5%.

3. A method according to claim 2, wherein each of A and B is present in about 5–95% by weight of A+B.

4. A method according to claim 1, wherein in the composition subjected to polymerization on a weight basis A+B is present in about 40–90%, and C is present in about 60–10%.

5. A method according to claim 4, wherein each of A and B is present in about 20–80% by weight of A+B.

6. A method according to claim 1, wherein the dispersion, based on the weight of water, emulsifying agent and (A)+(B)+(C) contains about 40–90% of water, about 0.1–5% of emulsifying agent, and about 5–59.9% of (A)+(B)+(C).

* * * * *